US005727796A

United States Patent [19]

Zhang

[11] Patent Number: 5,727,796

[45] Date of Patent: Mar. 17, 1998

[54] IN-LINE SKATE CONVERSION KIT

[76] Inventor: Ming Zhang, P.O. Box 184, Wadsworth, Ill. 60083

[21] Appl. No.: 512,206

[22] Filed: Aug. 7, 1995

[51] Int. Cl.[6] ..... A63C 17/18

[52] U.S. Cl. ..... 280/7.13; 280/7.14; 280/11.22; 280/11.27

[58] Field of Search ..... 280/7.13, 7.14, 280/7.12, 11.18, 11.22, 11.23, 11.27

[56] References Cited

U.S. PATENT DOCUMENTS

| | | | |
|---|---|---|---|
| 480,610 | 8/1892 | Nielson . | |
| 1,530,211 | 3/1925 | Siemnash . | |
| 5,092,614 | 3/1992 | Malewicz . | |
| 5,129,663 | 7/1992 | Soo . | |
| 5,320,366 | 6/1994 | Shing . | |
| 5,531,462 | 7/1996 | Gu | 280/11.22 X |

FOREIGN PATENT DOCUMENTS

| | | | |
|---|---|---|---|
| 839173 | 5/1952 | Germany | 280/7.13 |
| 2736855 | 3/1979 | Germany | 280/7.13 |
| 372927 | 7/1939 | Italy | 280/7.13 |

*Primary Examiner*—Kevin Hurley
*Assistant Examiner*—Michael Mar

[57] ABSTRACT

A kit for converting an in-line skate boot into a boot for performing a different athletic activity, such as ice skating, includes a first member, such as an ice skating blade, and a mounting member for each of the wheels of the in-line skate connected to the first member and spaced therealong. Each of the mounting members has an elongated slot for receiving the axle and the kit includes an arrangement for preventing movement of the first member along its elongated axis. The mounting members have an approximate configuration of the wheels so that the first member will appear to be mounted by the wheels of the in-line skate. The first member, instead of being a blade for ice skating, can be a flat snow skate member or can be a member for being engaged by bindings of a ski so that the boot of the in-line skate is converted into a ski boot.

12 Claims, 2 Drawing Sheets

IN-LINE SKATE CONVERSION KIT

BACKGROUND OF THE INVENTION a) Field of the Invention

The present invention is directed to a kit for converting an in-line skate into a shoe or device for performing second types of athletic activities, which include ice skating, skating on snow and skiing. The kit includes an elongated first member, such as a blade for an ice skate or a snow skate, which is connected to a plurality of mounting members, with one mounting member for each of the wheels of the in-line skate. Each of the mounting members has an approximate width of the wheel of the in-line skate and has an elongated slot so that the mounting members are received on the axles for the wheels after the wheels have been removed from the in-line skate. This will result in a device, such as an ice skate, which will have the blade being mounted by a plurality of the mounting members which will give the appearance of the wheels of the in-line skate.

b) Prior Art

In-line roller skates are known, and an example is disclosed in U.S. Pat. No. 5,092,614, whose disclosure is incorporated herein by reference thereto. As illustrated in FIG. 1 of the present application, the in-line skate 10 of U.S. Pat. No. 5,092,614 includes a boot 12 and a frame structure 14 which is attached to a sole 26 of the boot 12 at a toe position 28 and a heel position 30. The boot 12 includes a lower portion and an upper portion or cuff 18 with a liner 24, which cuff is mounted by a pivot 20. The lower portion and cuff have fasteners 22 for securing the boot around the foot of the participant. As illustrated, the frame structure 14 supports a plurality of four rollers or wheels 16*a*, 16*b*, 16*c* and 16*d*, which are mounted on axles 17*a*, 17*b*, 17*c* and 17*d* extending between side rails 32 and 34 of the frame 14. Adjacent the rear wheel 16*d*, a brake assembly 36 having a brake element 37 is provided.

While the skate of FIG. 1 has four wheels, some skates have less than four wheels and some skates have more than four wheels or rollers. The vast majority of the in-line skates being sold today have either three or four rollers. While the skate of FIG. 1 has separate cuff and boot, some models of the skate have the cuff and boot as a single member. Another variation in skates is the size of the wheel axles and there seems to be two different diameters for the axles used in the skate sold at the present time.

It has been suggested over the years to build a skate which can be converted from a roller skate to an ice skate. Examples of this are shown by U.S. Pat. Nos. 480,610 and 1,530,211. U.S. Pat. No. 5,129,663 provides a special boot or shoe which can receive either a member supporting a blade for an ice skate or a member supporting wheels that are arranged in line to form an in-line skate. U.S. Pat. No. 5,320,366, whose disclosure is incorporated herein by reference thereto, suggests an arrangement which is less dependent on a special boot or shoe. A conversion is obtained by replacing the rollers or wheels with an ice skating blade frictionally engaged with pairs of hardened plastic clamping elements for each of the positions where the wheels were removed. This results in a rather complicated arrangement for mounting the blade. The device may lack structural rigidity. In addition, the blade may slip relative to the frame during some skating maneuvers.

SUMMARY OF THE INVENTION

The present invention is directed to providing a kit for converting any in-line skate into a device or shoe for performing a second type of athletic activity, which kit for converting is simple to use, is inexpensive to manufacture and can be readily adapted to different frame structures of in-line skates having frame structures of different spacing, having different spacing between the axles and having different axle sizes or diameters. The shoe can be used for ice skating, for snow skating or for attaching a member on the boot which enable the boot to be used in bindings of skis.

To accomplish these goals, the present invention is directed to a kit for converting any in-line skates into a shoe, boot or device for performing a second type of athletic activity, said skate having a boot with a frame structure on the sole of the boot, said structure receiving a plurality of axles spaced along a line for mounting a plurality of wheels for rotation in the frame structure. The kit comprises an elongated first member for performing the second type of athletic activity with a mounting member for each wheel of the skate, each mounting member having an approximate width of the wheel with an elongated slot at the center of the mounting member for adapting to various sizes of the frame structure and spacing between axles, said mounting member being connected in a row along one side of the first member with a spacing corresponding to the spacing between the wheels and axles of the skate by a connection preventing relative movement between the first member and mounting member, and means for preventing movement of the first member along the line, said means being associated with at least one mounting member and engaging the axle extending through the slot of said at least one mounting member, so that by removing the wheels from the frame structure and inserting the axles through the slots of the mounting members and then actuating the means, the boot can be converted from an in-line skate to a shoe for the second type of athletic activity.

The mounting members may be permanently connected onto the first member. This may be accomplished by molding the separate mounting members onto the first member or by force fitting, locking, bonding or welding the mounting members onto the first member. It is also possible to form a bridge between the mounting members so that they are interconnected. The mounting members and first member can be formed as a one-piece member by molding out of plastic or by machining the member out of metal. The means for preventing or locking means can include at least a single screw inserted into a mounting member to engage the axle therein, or a screw in more than one mounting member. The locking means can include one or more keys inserted in slots to engage one or more axles or one or more positioning sleeves to engage at least one axle.

The first member may have a tab for each of the mounting members extending upward from one side, and this tab is telescopically received on a center plane of the mounting member so that an elongated slot in the tab is received in alignment with the elongated slot of the mounting member. To provide the means for preventing, at least one key may be inserted in a slot of one mounting member, which is preferably a middle mounting member, and through the slots of the tab associated therewith. The key has a size to engage the axle and entrap the axle in the slot. If two keys are used, they are placed in the slots of the first and last mounting members to engage the first and last axles of the frame structure or in any two mounting members and, thus, entrap the two axles. This will prevent a longitudinal shifting along the line formed by the axles. Another type of means for preventing includes a plurality of spacing or positioning sleeves, one of which has a circular hole the size of the axle and the others having eccentric and elongated holes, which sleeves are inserted based on the particular spacing between the axles to compensate for variations due to manufacturer's variations and/or variations due to changes in size of the particular boot and skate.

The blade for ice skating can either be a hockey blade or a figure skating blade. It is also possible to use this arrangement to mount a flat snow skating board.

The arrangement can also be used to mount a member which will enable utilizing the skate boot as a ski boot with the bindings of the ski engaging the first member attached by the kit.

In each of the embodiments, the aesthetic appearance is obtained by having the appearance that the first member, such as an ice skating blade, is secured in wheels of an in-line skate. Thus, the mounting members not only act to support and mount the blade and coact with means for preventing shifting of the blade, but also provide the appearance that a person is ice skating with their in-line skates.

Each embodiment provides a strong slip-free mounting of the first member in the frame structure of the boot.

Other advantages and features of the invention will be readily apparent from the following description of the preferred embodiments, the drawings and claims.

DESCRIPTION OF THE PREFERRED EMBODIMENTS

Figure 1:
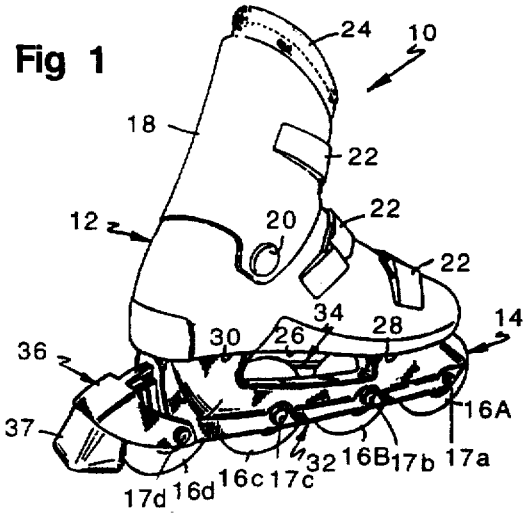
FIG. 1 is a perspective view of an in-line skate which is presently known.
Figure 2:
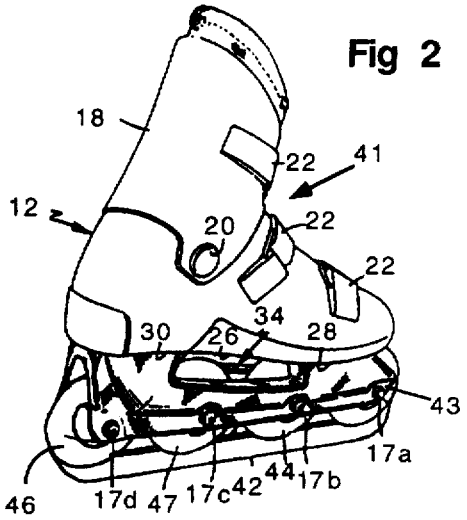
FIG. 2 is a perspective view of an in-line skate such as shown in FIG. 1 converted into a hockey ice skate utilizing the conversion kit of the present invention.
Figure 3:
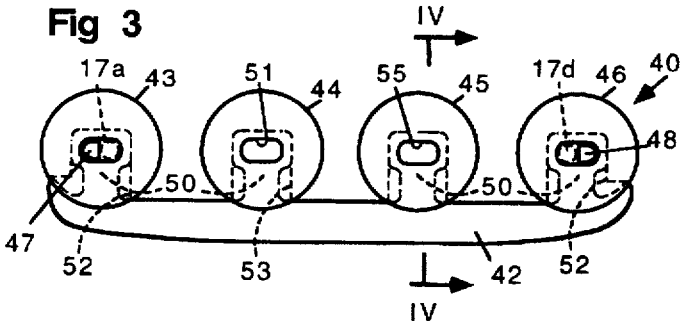
FIG. 3 is a side view of the roller-like mounting member and hockey blade such as illustrated in the conversion shown in FIG. 2.
Figure 4:
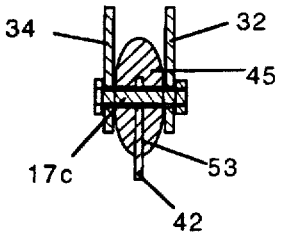
FIG. 4 is a cross sectional view taken along the lines IV—IV of FIG. 3 showing a mounting of the mounting member with a skate blade in a frame structure of a skate boot.

The principles of the present invention are particularly useful when incorporated in a conversion kit, generally indicated at 40 in FIG. 3, which converts a boot 12 of an in-line skate 10 into an ice skate, generally indicated at 41 in FIG. 2. The kit 40 of FIG. 3 includes a first member 42, which is illustrated as a hockey ice skating blade, four spacer or mounting members 43, 44, 45 and 46 and means for preventing movement including keys 47 and 48. The mounting members 43–46, as shown in FIG. 4, are of a substantially solid member having a slot-like cavity on a central plane for receiving tabs 50 of the blade or first member 42 with a tight fit. Each of the tabs 50 has an elongated slot 51. As illustrated in FIG. 3, the mounting members 43 and 46, which are the two outer or end members, have cavities 52 for receiving the tabs 50 and a tip of the blade forming the first member 42. In a similar manner, the mounting members 44 and 45, which are the intermediate mounting members, have rectangular slot-like cavities 53 for receiving the center two tabs. Each of the mounting members 43–46 have an elongated slot 55, which is aligned with the slot 51 of the tabs 50. As illustrated in FIG. 4, when the mounting member, such as 45, receives its respective tab 50, it extends an equal amount on each side of the tab.

The mounting members 43–46 and the tabs 50 have elongated slots because the spacing between the axles which are mounted on the rails, such as 32 and 34, of the frame structure will differ from different makes of in-line skates and also will be slightly different based on the size of the boot. Therefore, to accommodate these different spacings for the axle of different types of boots, the slots are elongated to provide tolerance for accepting the different spacings between the axles. Since the axles of in-line skates come in two different diameters, the slots 51 and 55 are of a size to accept the larger diameter axles. However, to prevent shifting of the kit 40 and to prevent the first member 42 from shifting along its length, locking means, such as keys 47 and 48, are provided. As illustrated, these keys 47 and 48 will engage one side of the axle 17*a* and 17*d*, respectively, to lock the blade in the longitudinal direction on the boot. By tightening the threads on the axle, such as 17*c* (FIG. 4), the mounting member, such as 45, will be entrapped and engaged between the two side rails. It should be pointed out that each of the mounting members 43–46 has a thickness that may be greater than the thickness of the wheels, but substantially the same as the inner race of the wheel bearings, which is entrapped between the side rails when the wheel is mounted in the frame structure.

Figure 8A:
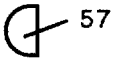
FIGS. 8*a*–8*d* are enlarged end views of four different locking keys used in the embodiment illustrated in FIG. 3.
Figure 8C:
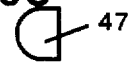
Figure 9:
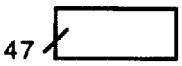
FIG. 9 is a side view of a locking key such as shown in FIG. 8*a;*
Figure 8B:
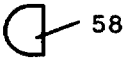
Figure 8D:
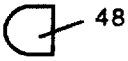

Referring to FIGS. 8*a*–8*d* and FIG. 9, the key 47 is shown in FIG. 8*c*, while the key 48 is shown in FIG. 8*d*. If the spacing between the two axles 17*a* and 17*d* is greater than that illustrated, then the key 57 of FIG. 8*a* or key 58 of FIG. 8*b* can be substituted for either one of keys 47 or 48. Different pairs of the four keys will provide different spacing. It is also possible to mount these keys so that they engage the inner side of the two axles 17*a* and 17*d* if that amount of spacing is necessary. It should be pointed out that all of the keys 47, 48, 57 and 58, which are part of an oval, have the same length, as illustrated by the key 47 in FIG. 9, and this length is substantially the same as or slightly less than the thickness of the mounting member, such as 45, at the slot 55. While FIG. 3 shows using two keys in two slots, a single key in a single slot may be used to entrap a single axle while the remaining axles are held loosely in the remaining slots.

Figure 5:
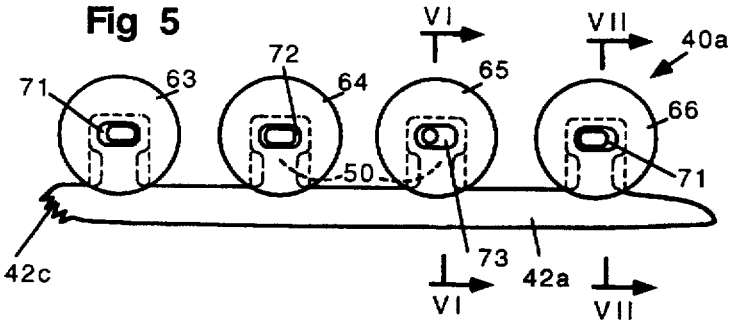
FIG. 5 is another side view of the assembled conversion kit with a figure skating blade and utilizing a different locking arrangement.
Figure 6:
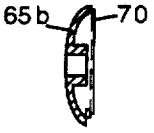
FIG. 6 is a cross sectional view taken along the lines VI—VI of FIG. 5 showing a modification of a half mounting member.
Figure 7:
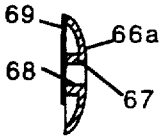
FIG. 7 is a cross sectional view taken along the lines VII—VII of FIG. 5 of another half mounting member.

In FIG. 5, an embodiment of the kit is indicated at 40*a* and has a first member 42*a* which is a figure skating blade with a rough toe portion 42*c* instead of a hockey blade. Another feature is that instead of each of the mounting members 43–46 being a solid member, the mounting members 63–66 are formed of two pieces, which are mirror symmetry and are joined together. These two molded pieces, as illustrated in FIGS. 6 and 7, have a hub portion, such as 67, which contains the elongated slot 68. In addition, one of these halves, such as the half 66*a* of FIG. 7, has recesses 69 for receiving a projection or pin member, such as the projection 70 of the half 65*b* of FIG. 6. The two pieces can be fused together with the pins in the recesses to form the two halves into a single mounting member on the tab 50.

Figure 11A:
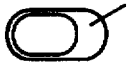
FIGS. 11*a*–11*f* are end views of six different spacing positioning sleeves for locking the first member in a fixed longitudinal direction on the boot.
Figure 11B:
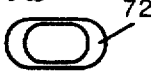
Figure 11C:
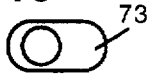
Figure 11D:
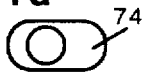
Figure 11E:
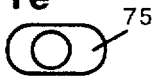
Figure 11F:
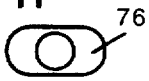

Another difference illustrated in FIG. 5 is that the lock means, instead of being formed by keys, such as 47 and 48, is formed by a plurality of positioning sleeves, such as 71–76, which are shown enlarged in FIGS. 11*a*–11*e*. As illustrated, two positioning sleeves 71, shown in FIG. 11*a*, are disposed in the opening or slots 68 of the outer two mounting members 63 and 66, a positioning sleeve 72 of FIG. 11*b* is disposed in the mounting member 64, while a positioning sleeve 73, shown in FIG. 11*c*, is received with the mounting member 65. The positioning sleeves, such as 73, have a smaller diameter for receiving an axle smaller than the axle received in the slot 55 in the embodiment of FIG. 3. It has been found that axles used on in-line skates appear to have two distinct diameters, and the sleeves 71–76 are constructed to receive the smaller diameter axle, whereas the slots 51 and 55 and the keys 47, 48, 57 and 58 are designed to be used with the larger axle. As illustrated, the sleeve 73 will completely entrap the axle 17*c* and, preferably, the front axle 17*a* and the rear axle 17*d* will be received in the sleeves 71 and engage one side thereof. The sleeve 72 will loosely receive the other axle with some play in the longitudinal direction. With different spacings, other sleeves, such as 74, 75 and 76 of FIGS. 11*d*–11*f*, can replace the sleeve 73 to allow an adjustment. If necessary, the sleeves can be turned 180° to obtain a different spacing.

Figure 18:
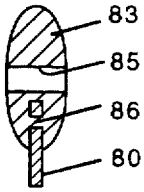
FIG. 18 is a cross sectional view taken on line XVIII—XVIII of FIG. 12.

In the kits 40 and 40*a* of FIGS. 3 and 5, each of the mounting members is mounted on its respective tab. In an embodiment illustrated in FIG. 12, the kit 40*b* has a first member 80 which is, again, a ice hockey blade, with integrally or rigidly fixed mounting members 81, 82, 83 and 84. These members 81, 82, 83 and 84 can be molded onto the member 80, or the mounting members may be secured on the first member by bonding, welding or soldering. It is also possible that the members 80 and 81–84 are a one-piece member that was molded or machined. Each of the mounting members has an elongated slot, such as 85, and the blade 80 has four elongated slots 86, which receive portions of the molded mounting member to secure the mounting member on the blade (see FIG. 18). Thus, unlike the embodiments of FIGS. 3 and 5, the blade does not have tabs with elongated slots which are aligned with the elongated slots of the mounting members. Another distinction is that the lock means is formed by providing a threaded fastener 88 in the mounting member 81 and a threaded fastener 89 in the mounting member 84, which threaded fasteners are threaded in to tightly engage sides of the first axle and the last axle to prevent movement along the line of the mounting members and along the length of the blade 80. It is possible to use only one screw to look a single axle, but two screws in two mounting members is preferred. Also, the screw can be in the intermediate members 82 and 83 instead of members 81 and 84. While not illustrated, instead of using the threaded fasteners 88 and 89, keys, such as shown in FIGS. 8*a*–8*d* and in FIG. 3, or positioning sleeves, such as shown in FIGS. 11*a*–11*f* and in FIG. 5, could be used. The thread fasteners or screws may also be used with the kits 40 and 40*a* of FIGS. 3 and 5.

Figure 12:
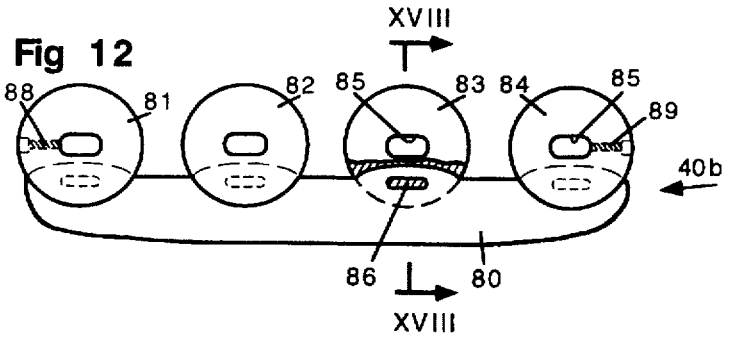
FIG. 12 is a side view similar to FIG. 3 of an embodiment with portions broken away for purposes of illustration of a first member with rigidly-connected mounting members.
Figure 13:
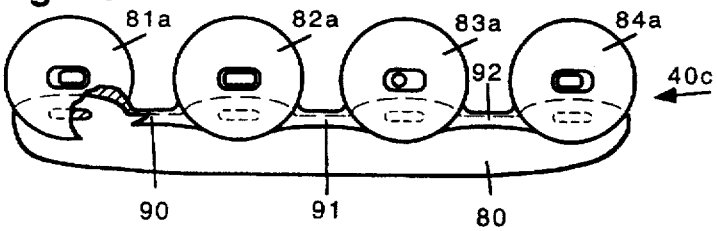
FIG. 13 is a side view of another embodiment of the rigidly-connected mounting members and first member.

An embodiment or modification of the kit is generally indicated at 40*c* in FIG. 13, which has the blade 80 and differs from the embodiment of FIG. 12 in that mounting members 81*a*, 82*a*, 83*a* and 84*a*, while being molded directly onto the blade 80, are also interconnected by bridge portions, such as the bridge portion 90 extending between the members 81*a* and 82*a*, the bridge portion 91 extending between the members 82*a* and 83*a* and the bridge portion 92 extending between the members 83*a* and 84*a*. While this embodiment 400 is illustrated as having the positioning sleeves, such as 71, 72 and 73, it can incorporate or use the spacing keys, such as shown in FIGS. 8*a*–8*d*, or can be provided with the threaded means, such as 88 and 89, as illustrated in the embodiment 40*b* of FIG. 12.

Figure 14:
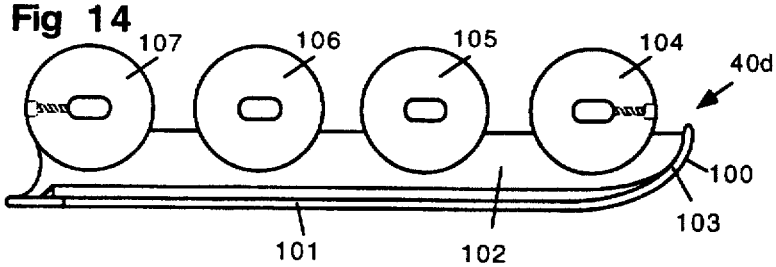
FIG. 14 is a side view of a kit for converting the in-line skate into a snow skate.
Figure 15:
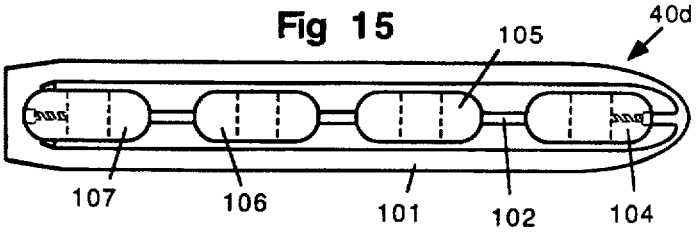
FIG. 15 is a top plan view of the snow skate of FIG. 14.

Each of the previous embodiments were with an ice skating blade. In the kit, generally indicated at 40*d* in FIGS. 14 and 15, a snow skate is provided. In a manner similar to the embodiments 40*b* of FIG. 12, a first member 100 has a flat bottom or runner 101 with a ridge or vertical member 102 extending down the middle. At a front end, the flat runner 101 curves upward to form a ski-like end 103. Four mounting elements or members 104, 105, 106 and 107 are mounted on the upright vertical member 102 and attach thereto by being molded thereon. Each of the mounting members 104–107 has an elongated slot for receiving the axle of the in-line skate after the wheels have been removed. As in the previous embodiments, positioning or lock elements, such as the positioning sleeves 71–76, can be used in the slots to maintain or prevent movement in the longitudinal direction. Instead of using positioning sleeves, the keys, such as shown in FIGS. 8*a*–8*d*, can be utilized or the mounting members 104 and 107 can each be drilled and tapped to receive a threaded fastener for engaging the first and last axles of the skate. With the kit 40*d* mounted, one is then able to skate on hard-packed snow in a manner similar to ice skating, but with the broad, short ski-like runner 101.

Figure 16:
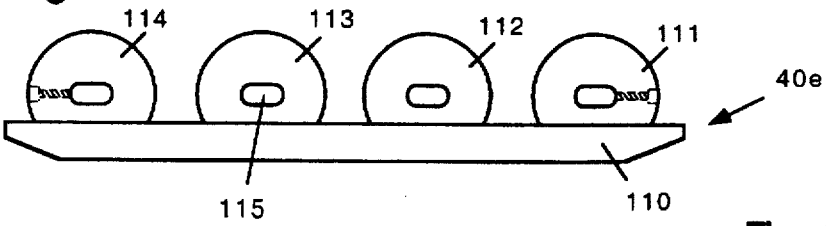
FIG. 16 is a side view of the kit for converting the in-line skate to a downhill ski boot.
Figure 17:
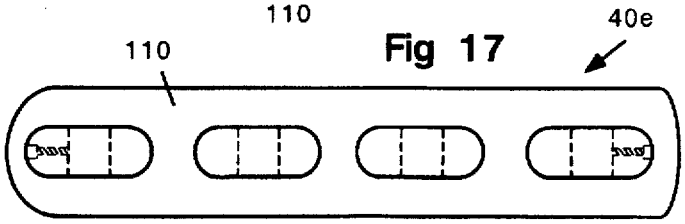
FIG. 17 is a top plan view of the conversion kit of FIG. 16.

In FIGS. 16 and 17, another example of a conversion kit, generally indicated at 40*e*, is shown. This conversion kit includes a first member 110 with attached mounting members 111, 112, 113 and 114. Each of the mounting members 111–114 has the elongated slot, such as 115, and the leading or front end mounting member 111 and the back mounting member 114 are each provided with threaded fasteners for locking the kit on the axles of the skate. The first member 110 is designed to provide surfaces for gripping by a ski-binding for downhill skiing and, thus, converts the in-line skate into a ski boot. The entire member can be formed and molded as a one-piece member, if desired.

Figure 10:
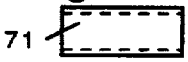
FIG. 10 is an enlarged side view of a positioning sleeve used in another embodiment for locking the first member in a longitudinal direction.

In utilizing the fasteners, such as 88 and 89 of FIG. 12 or 117 and 118 of FIG. 10, these can be metal threaded fasteners or can be plastic threaded fasteners.

The positioning sleeves 71–76 are preferably formed of a plastic material; however, metal sleeves could be utilized. In a similar manner, the keys of FIGS. 8*a*–8*d* can be formed preferably of plastic keys but can be formed as metal keys.

Unless the kit is coming with threaded fasteners, such as 88 and 89, it will be provided with both a set of keys and a set of positioning sleeves so that it can be used with in-line skates having both the large diameter axles and the in-line skates having the small diameter axles. In other words, whether one uses the keys or the sleeves depends on the particular axle of the in-line skate which is being converted into a shoe for other athletic purposes.

As pointed out hereinabove, the kit containing both the keys and the positioning sleeves can be used to convert any in-line skate for other athletic purposes, such as ice hockey skating. Having obtained the kit, one then selects either the keys or the sleeves, depending on which size axle they have, and then selects the desired combination to obtain the desired spacing which is necessary to receive the axles of the in-line skate and to prevent any movement along the line of the mounting members. In all embodiments, the preferred design of the mounting members is such as to give the appearance that the first member, such as the hockey blade or ice skating blade, is extending from the rollers of an in-line skate.

As mentioned above, the mounting members have a width approximately the same as the width of the rollers or wheels. The mounting members may have a diameter smaller than the diameter of the roller so that the first member will not be spaced too far from the sole of the boot.

Although mounting members which look like rollers are preferred, other shapes, such as ovals, rectangles or triangles, can be used.

Although various minor modifications may be suggested by those versed in the art, it should be understood that I wish to embody within the scope of the patent granted hereon all such modifications as reasonably and properly come within the scope of my contribution to the art.

I claim:

1. A kit for converting any in-line skate into an ice skate, said in-line skate having a boot with a frame structure on a sole of the boot, said structure receiving a plurality of axles spaced along a line for mounting a plurality of wheels for rotation, said kit comprising an ice skating blade with a blade edge; a mounting member for each wheel of the skate, each mounting member having an approximate width of the wheel and a shape similar to a wheel with an elongated slot at the center of the mounting member, said ice skating blade having a tab on an edge opposite the blade edge for each of the mounting members, each tab having an elongated slot, each of said mounting members having a cavity on a central plane of the member for receiving the tab with the slot of the tab aligned with the slot of the respective mounting member for receiving an axle extending through the slot of the mounting member and tab; and means for preventing movement of the ice skating blade along the line, said means being associated with at least one mounting member and engaging the axle extending through the slot of said at least one mounting member so that by removing the wheels from the frame structure and inserting the axles through the slots in the mounting members and tabs and then engage an axle with the means, the boot can be converted from an in-line skate to an ice skate.

2. A kit according to claim 1, wherein the means for preventing includes a threaded fastener in the at least one mounting member for engaging the axle extending therethrough.

3. A kit according to claim 1, wherein the means for preventing are threaded fasteners received in the first and last mounting members for engaging the first and last axles.

4. A kit according to claim 1, wherein the means are a plurality of positioning sleeves received in the elongated slots of the mounting members, one of said positioning sleeves having a circular passage of a size for receiving an axle therethrough, the other positioning sleeves having oblong openings for receiving axles with play in a longitudinal direction of the first member.

5. A kit according to claim 1, wherein the means includes spacer keys, said spacer keys being received in the elongated slots of the front and rear mounting members to engage axles extending therethrough, said keys being selected to compensate for different spacing between the front and rear axle.

6. A kit according to claim 1, wherein each of the mounting members is a single, one-piece member.

7. A kit according to claim 1, wherein each of the mounting members is formed of two halves which are assembled together, said halves each having a hub surrounding the elongated slot.

8. A kit according to claim 1, which includes four tabs and four mounting members.

9. A kit according to claim 8, wherein the means includes positioning sleeves disposed through the slots of the mounting member and associated tab, the positioning sleeves in the front and rear mounting members having an oblong opening, one of the inner two mounting members having a sleeve with a circular opening of the size for receiving the axle and the other having an oblong opening therethrough to receive the axle with play.

10. A kit according to claim 8, wherein the means includes a spacing key disposed in the leading mounting member and in the rear mounting member for engaging the first and last axles, said slots of the middle two mounting members and tabs being free of spacing keys.

11. A kit according to claim 1, wherein the means for preventing are a spacing key disposed in the slot of the at least one mounting member to entrap the axle in the slot of the at least one mounting member and associated tab.

12. A kit according to claim 1, wherein the means for preventing are a plurality of positioning sleeves having an oval outer surface corresponding to the elongated slot of the tabs and mounting members with the positioning sleeves received in the slots of the front and rear mounting members having elongated passages to loosely receive the axles therein and a sleeve in an intermediate mounting member having a passage with a circular cross section for receiving the axle and engaging the axle extending therethrough.

* * * * *